United States Patent [19]

Metzinger et al.

[11] 4,050,846

[45] Sept. 27, 1977

[54] FLUID CIRCULATING APPARATUS

[75] Inventors: Wolfgang Metzinger, Grossniedesheim; Bernd Böll, Frankenthal; Peter Hergt, Ludwigshafen, all of Germany

[73] Assignee: Klein, Schanzlin & Becker Aktiengesellschaft, Frankenthal, Germany

[21] Appl. No.: 698,747

[22] Filed: June 22, 1976

[30] Foreign Application Priority Data

June 25, 1975 Germany ..... 2528210

[51] Int. Cl.[2] ..... F04D 29/44; F04D 29/40

[52] U.S. Cl. ..... 415/182; 138/39; 138/42; 415/216; 415/219 R

[58] Field of Search ..... 415/175–176, 415/177, 182, 183, 178, 179, 204, 206, 216, 217, 218, 219 R, 219 C, DIG. 7; 138/39, 42

[56] References Cited

U.S. PATENT DOCUMENTS

| | | | |
|---|---|---|---|
| 2,419,159 | 4/1947 | Pezzillo | 415/177 |
| 2,612,310 | 9/1952 | Eggmann | 415/179 |
| 3,322,071 | 5/1967 | Teter | 415/53 |
| 3,355,097 | 11/1967 | Hornschuch | 415/177 |
| 3,411,451 | 11/1968 | Matthias et al. | 415/183 |
| 3,685,919 | 8/1972 | Speck et al. | 415/53 |
| 3,874,813 | 4/1975 | Honold et al. | 415/219 C |

*Primary Examiner*—C. J. Husar
*Attorney, Agent, or Firm*—Michael J. Striker

[57] ABSTRACT

A fluid circulating apparatus includes a housing which forms a part of an aggregate, for instance a heat exchanger. The housing has an inlet portion for admission of fluid into a first compartment and an outlet port which communicates with a pressure chamber of the housing. One wall of the housing has at least one aperture through which fluid can flow from the first compartment into the heat exchanger proper, and at least one second aperture through which fluid flows from the heat exchanger proper into a second compartment. A pump in the pressure chamber draws fluid from the second compartment through an opening in a funnel-shaped member extending transversely through the housing and discharges pressurized fluid into the pressure chamber. An inclined wall extending between the funnel-shaped member and an opposite housing wall separates the first from the second compartment.

6 Claims, 5 Drawing Figures

FLUID CIRCULATING APPARATUS

BACKGROUND OF THE INVENTION

The present invention relates to a fluid circulating apparatus in which a pump is arranged in a housing of an aggregate, for instance a heat exchanger, which is arranged in the fluid circuit, whereby the housing in which the circulating pump is arranged is divided by interior walls in such a manner to form an inlet space for the aggregate, an inlet space for the circulating pump and a pump pressure chamber, and in which the inlet space for the aggregate is connected by one or a plurality of apertures with a first compartment through which fluid enters the housing and in which the inlet space for the circulating pump is connected with the outlet of the aggregate and in which in the interior of the housing a cup-shaped body is provided formed with an opening for the flow of fluid to the impeller of the circulating pump.

Such a fluid circulating apparatus is known in the art and is disclosed in the U.S. Pat. No. 3,874,813.

SUMMARY OF THE INVENTION

It is an object of the present invention to provide a fluid circulating apparatus of the aforementioned kind in which the flow conditions of the fluid through the apparatus are improved, and in which the construction of the apparatus is simplified as compared to the known apparatus.

With these and other objects in view, which will become apparent as the description proceeds, the fluid circulating apparatus according to the present invention mainly comprises a hollow housing having an inlet port and an outlet port and including internal partitions subdividing the interior of the housing into a first chamber communicating with the outlet port and a second chamber including a first compartment communicating with the inlet port and a second compartment, in which the partitions include a funnel-shaped member extending transversely through the housing and having a central opening providing communication between the second compartment and the first chamber, and an inclined wall separating the first compartment from the second compartment, in which the housing has further an at least one first aperture through which fluid which enters the first compartment via the inlet port can leave the first compartment and pass for instance in a heat exchanger connected with the housing, and at least one second aperture through which fluid leaving the first compartment via the first aperture can enter from the heat exchanger into the second compartment. The apparatus includes further a circulating pump installed in the first chamber and arranged to draw fluid through the central opening in the funnel-shaped member from the second compartment and to discharge pressurized fluid into the first chamber and from the latter through the outlet port.

In this construction the funnel-shaped member serves to separate the second chamber from the pressurized first chamber, whereas the inclined wall divides the second chamber into two compartments, from the first of which fluid entering through the inlet port passes into the heat exchanger and from the second of which the fluid entering from the heat exchanger passes into the inlet of the pump.

The geometry of the second compartment, which forms the discharge space for the heat exchanger and at the same time an inlet space for the pump, is constructed in such a manner, that the fluid passing in streams from the conduits of the heat exchanger is considerably decelerated in the second compartment and under renewed acceleration guided into the impeller of the pump in a substantially turbulence-free manner and, with a speed profile substantially equal over the whole inlet cross section of the pump.

The construction of the partitions according to the present invention will result in a simplified solution for the division of the pump housing into an inlet space for the heat exchanger, an inlet space to the impeller of the pump and a pressure chamber for the pump, and therewith will permit a simple and cost-saving manufacture of the various elements and the assembly thereof to the complete fluid circulating apparatus. In order to separate the various spaces from each other only two partitions are necessary which are of simple shape and can therefore be manufactured at very reasonable cost. A further simplification of the arrangement can be obtained by arranging the inlet port and the outlet port in a common tubular socket, separated from each other by an extension of the funnel-shaped member.

By the construction of the funnel-shaped member and the inclined wall connected thereto the flow losses are reduced and an equalization of the flow profile in the inlet plane of the pump impeller obtained, which is advantageous for the loading of the bearing for the impeller shaft and therewith for the operating safety of the apparatus.

Due to the rotation symmetry of the funnel-shaped member and the inclined wall connected thereto, which separates the first from the second compartment, it is possible to properly estimate the tensions which will occur in these members which further will simplify the construction of the apparatus.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
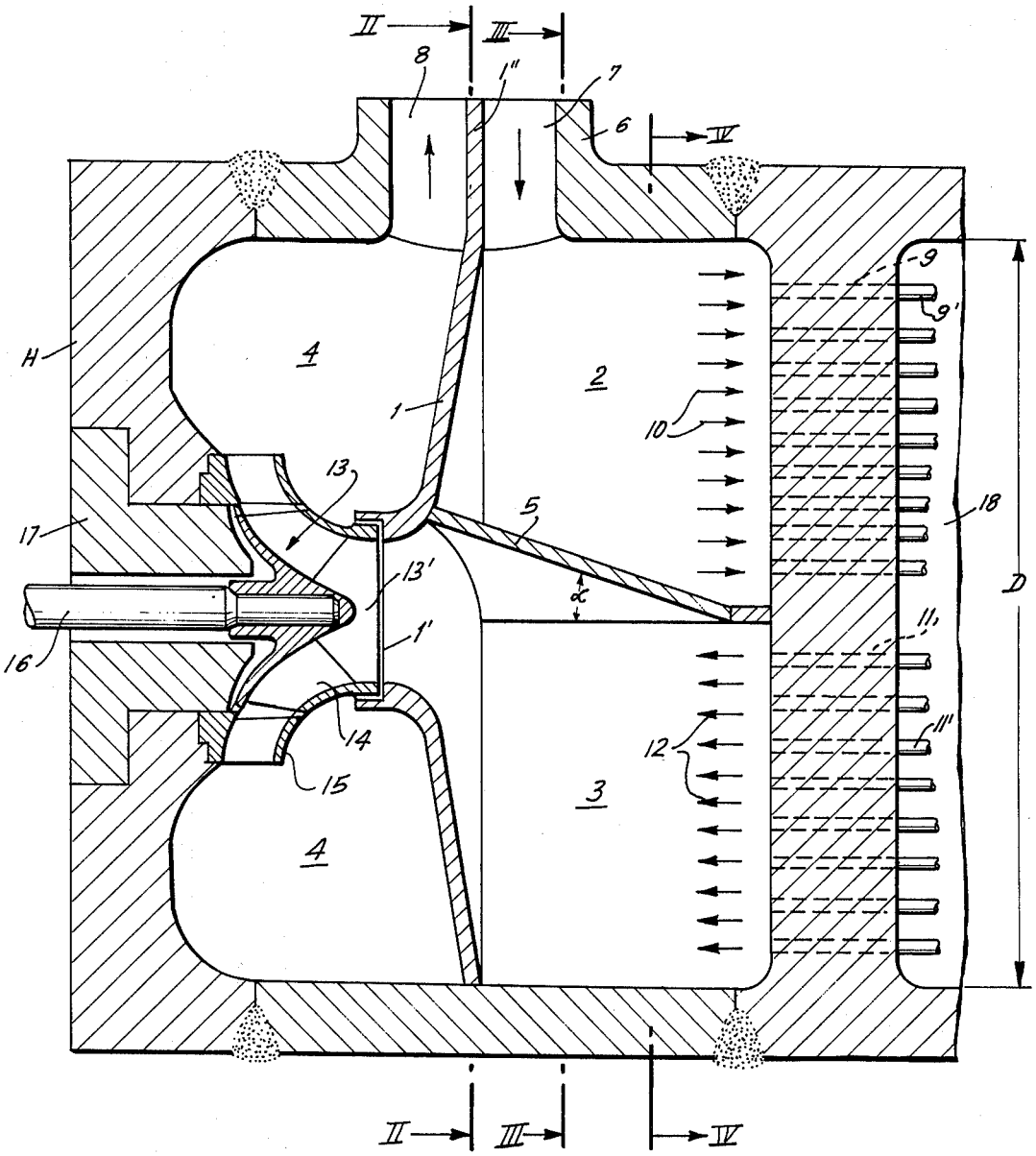
FIG. 1 is a longitudinal cross section through the fluid circulating apparatus according to the present invention.

Referring now to the drawing, it will be seen that the fluid circulating apparatus according to the present invention comprises a hollow housing H which is divided by a funnel-shaped member 1 into a first chamber 4 located to the left side of the member 1, as viewed in FIG. 1 and a second chamber located at the right side of this member. The second chamber is divided by an inclined wall 5 connected at one end to the funnel-shaped member 1 adjacent the central opening 1' thereof, and on the other end to the right wall of the housing H as viewed in FIG. 1, into a first compartment 2 and a second compartment 3. The first compartment 2 communicates with an inlet port 7 through which fluid is fed into the housing H, whereas the first chamber 4 communicates with an outlet port 8 through which fluid is discharged from the housing H. The two ports are preferably arranged in a common tubular socket 6 provided in the upper end wall of the housing H and separated from each other by a portion 1'' of the funnel-shaped member 1 extending centrally through the socket 6. A circulating pump 13, having an impeller 14 mounted on a shaft 16 for rotation therewith, is located in the first chamber 4 and has an inlet end 13' coaxially located in the central opening 1' of the funnel-shaped member. The circulating pump 13 is provided, at the outlet end of the impeller, in the usual manner, with a ring of guide vanes 15. The impeller shaft 16 is mounted in bearing bushing 17 and driven by drive means, not shown in the drawing.

The housing H is integrally connected to a heat-exchanger 18, only partially and schematically illustrated in FIG. 1, whereby the right end wall, as viewed in FIG. 1 of the housing H forms part of the heat exchanger. This wall is formed in the area of the first compartment 2 with a plurality of apertures 9 therethrough through which tubes 9' for the heat exchanger 18 extend so that fluid entering through the inlet port 7 will pass in the direction of the arrows 10 through the right end wall of the housing and the tubes 9' in the apertures 9 into the heat exchanger. The tubes 9' are connected, in a known manner, in the part of the heat exchanger 18 not shown in FIG. 1, to tubes 11' passing through apertures 11 into the second compartment 3. The fluid passing through the tubes 11', in the direction as indicated by the arrows 12, into the second compartment 3 is sucked therefrom by the circulating pump 13 and discharged in pressurized form into the first chamber 4 and then through the outlet port 8. The apertures 9 and 11 are only shown in part in FIGS. 2–4.

Figure 2:
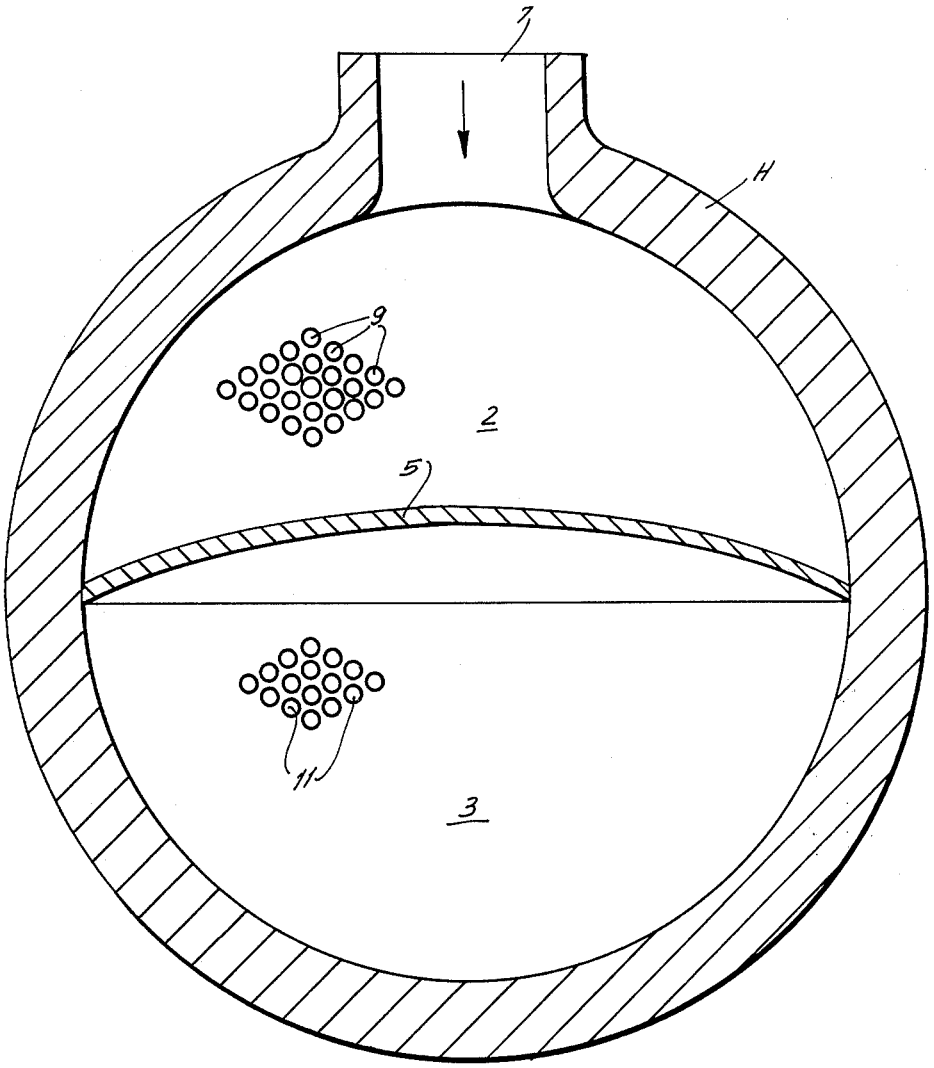
FIG. 2 is a cross-section taken along the line II—II of FIG. 1.
Figure 3:
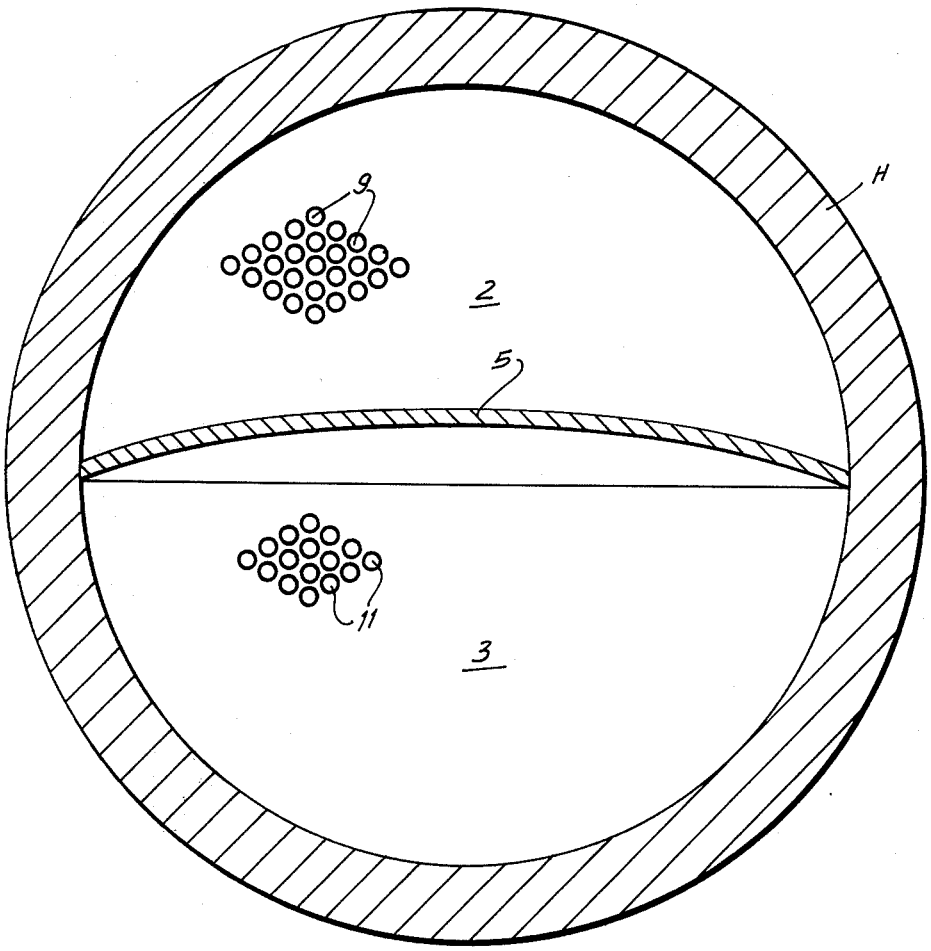
FIG. 3 is a cross section taken along the line III—III of FIG. 1.
Figure 4:
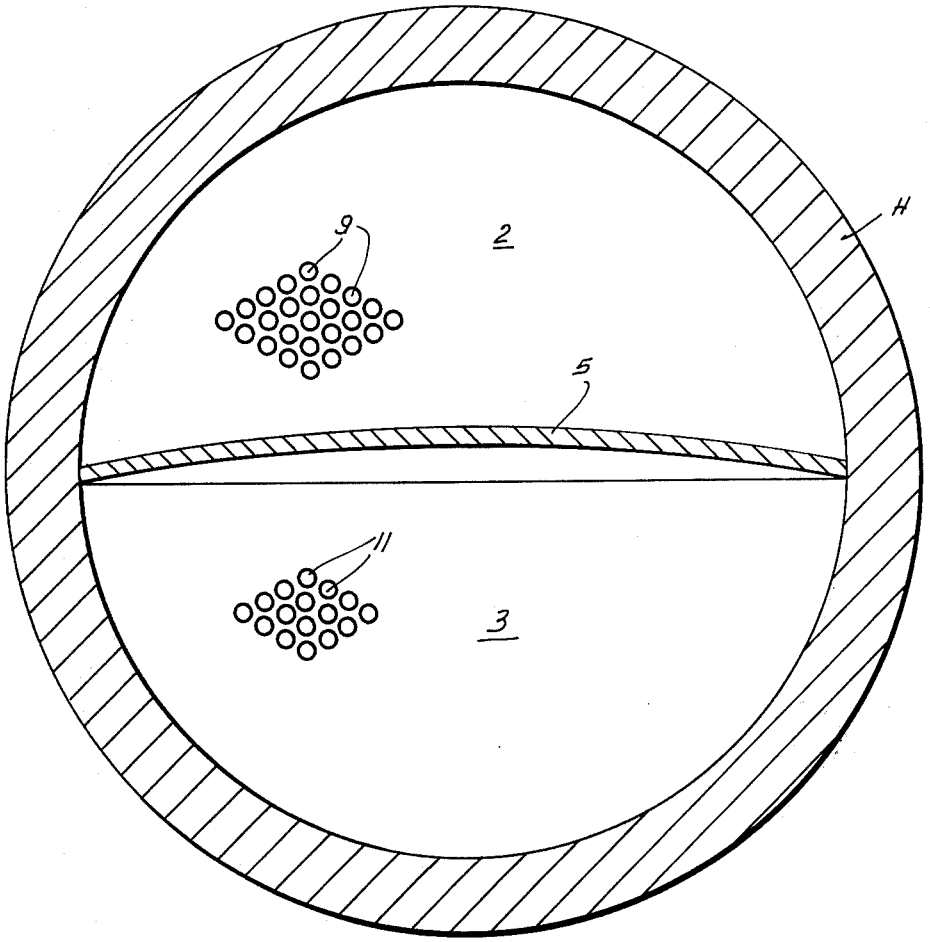
FIG. 4 is a cross-section taken along the line IV—IV of FIG. 1.

The inclined separating wall 5 is, as best shown in FIGS. 2–4, convexly curved toward the inlet port 7 and the radius of curvature R of the curved separating wall 5 increases from the funnel-shaped member 1 toward the right end wall of the housing H. The radius of curvature R of the separating wall 5 adjacent the funnel-shaped member 1 is equal $a \times D$, in which $a$ is coefficient and D the inner diameter of the heat exchanger 18. Adjacent to the right end wall of the housing, the radius of curvature of the separating wall 5 is infinite. The apex line of the curved wall 5 includes an angle $\alpha$ with an axis of symmetry of the housing.

Figure 5:
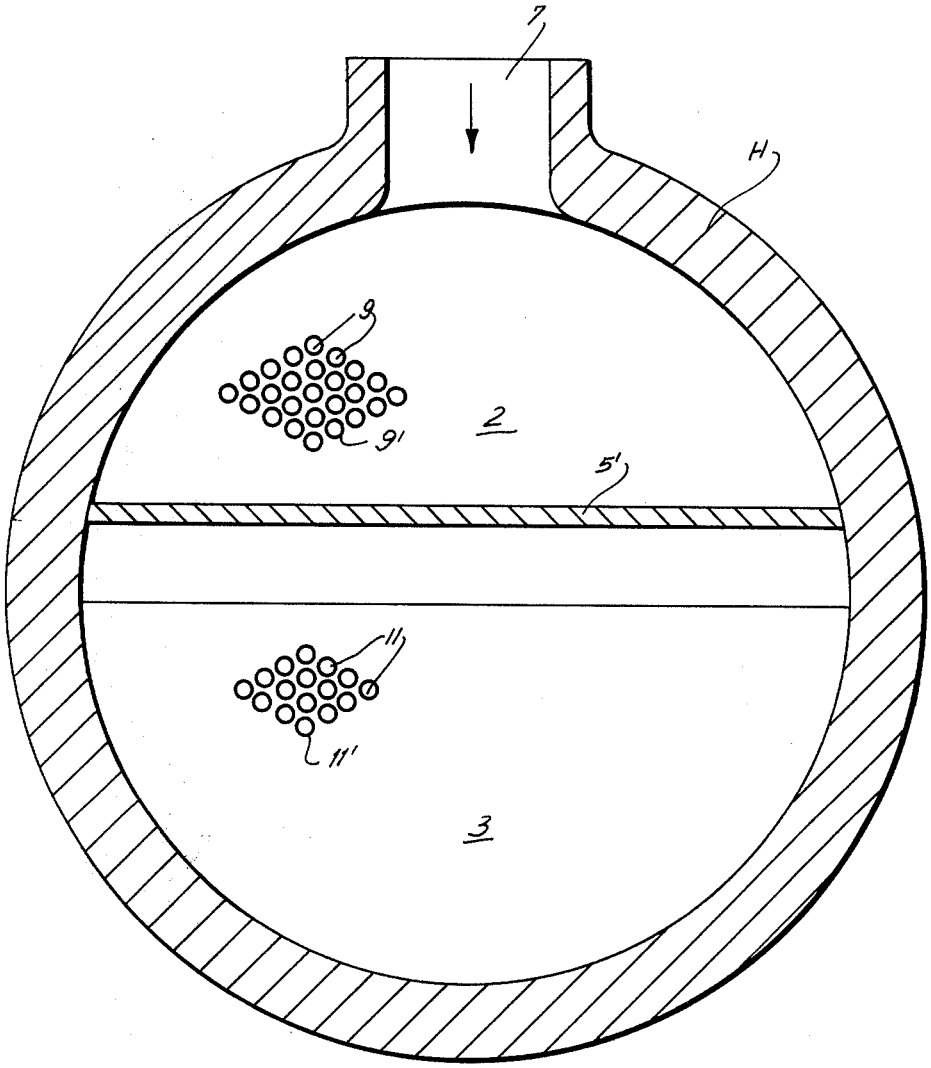
FIG. 5 is a cross-section similar to FIG. 2, but showing a modified inclined wall.

The angle $\alpha$ is always greater than zero, but the coefficient of curvature $a$ of the inclined wall can be infinite, that is the separating wall 5 can also be in form of a plane wall 5' as shown in FIG. 5.

It will be understood that each of the elements described above, or two or more together, may also find a useful application in other types of fluid circulating apparatus differing from the types described above.

While the invention has been illustrated and described as embodied in a fluid circulating apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a fluid circulating apparatus, a combination comprising a hollow housing having an inlet port and an outlet port arranged adjacent each other in a common tubular socket provided in one wall of said housing, and including internal partitions subdividing the interior of the housing into a first chamber communicating with the outlet port, and a second chamber including a first compartment communicating with said inlet port and a second compartment, said partition including a funnel-shaped member and extending transversely through said housing and having a central opening providing communication between said second compartment and said first chamber, and an inclined wall separating said first compartment from said second compartment, said funnel-shaped member extending with peripheral portion thereof through said socket and separating said ports from each other, said housing further having at least one first aperture through which fluid which enters said first compartment via said inlet port can leave said first compartment and at least one second aperture through which fluid leaving said first compartment via said first aperture can enter said second compartment; and a circulating pump installed in said first chamber and arranged to draw fluid through said central opening in said funnel-shaped member from said second compartment and to discharge pressurized fluid into said first chamber and from the latter through said outlet port.

2. A combination as defined in claim 1, wherein said pump is a rotary impeller pump having an inlet coaxial with said opening of said funnel-shaped member.

3. A combination as defined in claim 2, wherein said inclined wall extends from a region of said funnel shaped member adjacent said opening to a housing wall opposite said inlet of said pump.

4. A combination as defined in claim 3, wherein said inclined wall is a planar wall.

5. A combination as defined in claim 3, wherein said inclined wall is a curved wall convexly curving towards said inlet port.

6. A combination as defined in claim 5, wherein the radius of curvature of said convexly curved wall increases from said funnel-shaped member toward said opposite housing wall.

* * * * *